United States Patent [19]

Van Iperen

[11] Patent Number: 4,485,956

[45] Date of Patent: Dec. 4, 1984

[54] NAILING TOOL

[75] Inventor: Willem H. P. Van Iperen, Westfield, N.J.

[73] Assignee: Sea-Land Industries, Inc., Elizabeth, N.J.

[21] Appl. No.: 464,339

[22] Filed: Feb. 7, 1983

[51] Int. Cl.[3] ..... B25G 1/02

[52] U.S. Cl. ..... 227/147; 227/149; 173/132

[58] Field of Search ..... 227/147, 149, 113; 173/128, 132

[56] References Cited

U.S. PATENT DOCUMENTS

| | | | |
|---|---|---|---|
| 2,066,427 | 7/1937 | Smith | 173/132 |
| 2,199,833 | 5/1940 | Fleischman | 227/149 X |
| 2,244,048 | 6/1941 | Butler | 227/149 |

*Primary Examiner*—Paul A. Bell

[57] ABSTRACT

An improved nailing tool for supporting and driving a nail in which an elongated tubular guide sleeve member has means at one end for releasably retaining a nail to be driven and a hand grip at the opposite end. The nail driving rod is axially slidable in an elongated tubular guide sleeve member in which the lower end engages the nail retaining means and the upper end extends beyond the hand grip with the nail retaining means having an anvil in which there is an axial bore for cooperatively receiving a nail head therein with the anvil having a substantially planar driving rod impact surface on the face of the anvil opposite from the bore. Means are included in the axial bore for releasably engaging a nail head upon axial displacement of the nail driving rod in the guide sleeve member.

3 Claims, 6 Drawing Figures

NAILING TOOL

BACKGROUND AND OBJECTIVES OF THE PRESENT INVENTION

Various types of hammers and nailing devices including electric hammers and pneumatic tools for inserting nails, rivets, bolts and staples into a material for secure fastening.

The present invention is directed to the holding, positioning and driving a fastener such as a headed nail into an appropriate surface for securing a strap or web into a specific position in a plate that necessitates a moderate degree of accuracy for insertion of a nail within closely confined quarters which may prohibit the use of a conventional carpenters claw hammer.

It is an objective the present invention to provide a nailing tool that will releasably retain a headed nail in an anvil with a plunger for driving the nail directly in a specific location with an axial impact without nail displacement laterally.

Yet another objective of the present invention is the provision of an anvil positioned in a nailing tool in which the anvil is provided with releasable nail retaining implements that will facilitate nail insertion and removal in a portable nailing tool that may be readily used in closely confined areas.

Other objectives or many of the attendant advantages of the present invention for a nailing tool will become more readily apparent to those skilled in the carpentry and hand tool arts taken in conjunction with the accompanying drawing, specification and claims in which modifications and mechanical equivalents are contemplated.

DETAILED DESCRIPTION OF PREFERRED EMBODIMENT OF THE INVENTION

Figure 1:
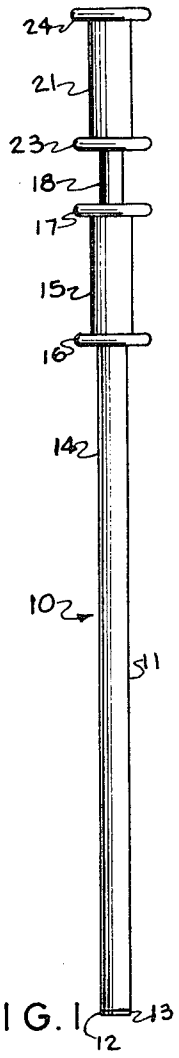
FIG. 1 is a front elevational view of a nailing tool embodying this invention in the nail driven position of the tool.

There is illustrated in FIG. 1 a nailing tool 10 embodying the present invention in which an elongated cylindrical guide tube 11 is provided at its lower end 12 with a nail-receiving anvil 13, preferably welded together, and at its upper end 14 a cylindrical hand grip member 15 with axially spaced apart circular flanges 16 and 17 that will limit hand displacement. A solid steel cylindrical nail driving rod 18 is slidably retained for vertical displacement in the sleeve or cylindrical tubular member 11 with its lower end 19, shown in FIG. 2, resting against the top end 20 of anvil 13 that is threadably secured to the lower end 12 of the tubular member 11. The upper end of the driving rod 18 is also provided with a hand grip member 21 with axially spaced hand grip flanges 22 and 23. The hand grips 15 and 21 are securely fastened to the tubular member 14 and rod 18, respectively.

Figure 2:
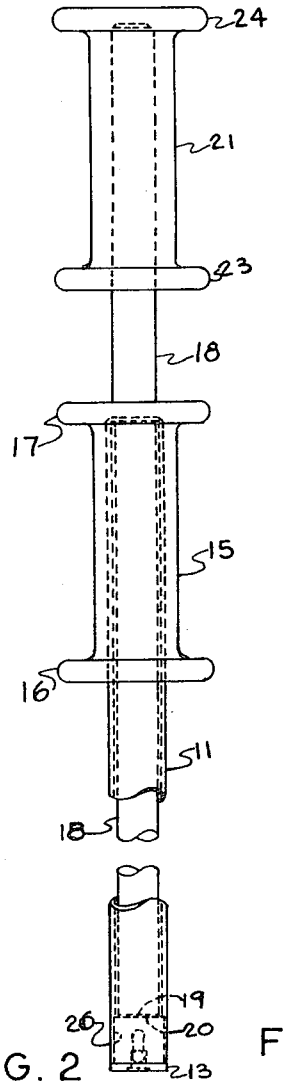
FIG. 2 is an enlarged partial front elevational view with portions removed and other portions shown in outline form only.
Figure 3:
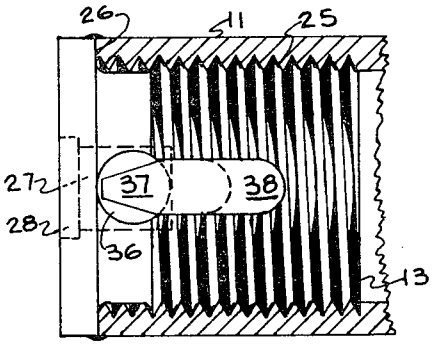
FIG. 3 is an enlarged side view of the nail retaining anvil with portions shown in outline form only.

As shown in FIG. 2, rod 18 is telescoped through the guide tube 11 with each of the hand grips 15 and 21 being preferably constructed of suitable steel, being securely fastened as by shrinking or keying to the guide tube 11 or the driving rod 18 with the driving rod 18 being freely slidable axially through the guide sleeve or tubular member 11.

The anvil 13 more clearly shown in FIGS. 3–6 for supporting a nail or other fastening means in the anvil is provided with a threaded plug section 25 which cooperates with the internal thread 26 in the lower end 12 of the tubular member 11 for retention therein. The protruding circular flange 26 at the operative end of the anvil 13 extends outwardly to be flush with the circumference of the lower end 12 of the tubular member 11 as shown in FIGS. 1 and 2. Anvil 13 is a solid steel plug in which an axial nail-receiving bore 27 has been drilled and in which there is an enlarged terminal base opening 28 which is also axially coincident with the axial bore 27 for cooperatively receiving and retaining a nail head 29 against the base 30 of bore 27 and in which the enlarged opening 28 will receive the second head 31 of a double-headed nail 32 which is spaced from the head 30 by the spacer shank 32.

Figure 4:
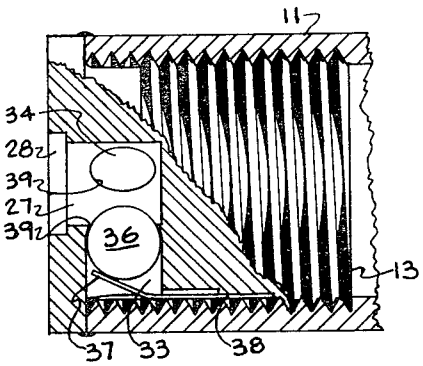
FIG. 4 is an enlarged side view as shown in FIG. 3 with a section removed to illustrate the nail-retaining axial bore and the resilient nail retention means.
Figure 5:
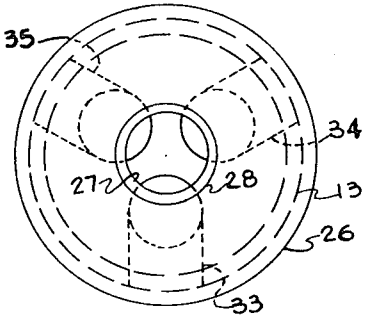
FIG. 5 is a bottom view of the anvil which is a left end view of FIG. 3 with portions shown in outline form.

A series of radially extending bores 33, 34 and 35 is circumferentially spaced about the anvil to communicate with the axial bore 27. Each radial bore 33, 34 and 35 cooperatively receives therein a steel spherical ball 36 as shown in FIGS. 4 and 6 for radial displacement by means of the depending leaf spring member 37 for each radial bore 33, 34 and 35, with its upper end 38 being securely fastened to a recess in the threaded section 25 of the periphery of the anvil 13 for retention therein with the depending spring section 37 being inclined inwardly to urge the spherical balls 36 in the direction of the axial bore 27 with the ball displacement being limited by the narrowed orifice or limit stop 39 in each radial bore that communicates with the axial bore 27 as shown in FIGS. 4 and 6.

Figure 6:
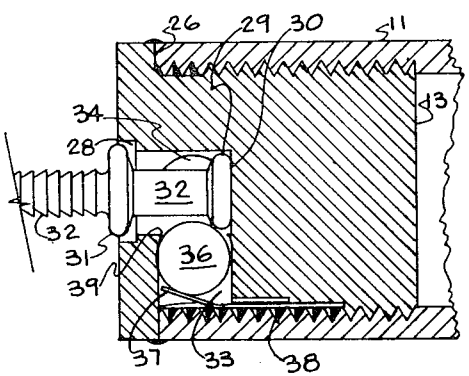
FIG. 6 is a partial transverse sectional view of the anvil of FIG. 3 illustrating a nail portion with the nail head and shank portion releasably supported in the anvil axial bore.

As illustrated in FIG. 6, the double-headed nail 32 is inserted into the axial bore 27 displacing the spherical balls 36 in their radial openings 33, 34 and 35, with the balls 36 being resiliently urged radially inwardly to engage the nail head 29 and retain it in position in the anvil. The flange 26 of the anvil will abut against the lower end of the guide tubular member 11. Upon displacing rod member 18 upwardly and then rapidly plunging it into the tubular member 11 against the top 20 of anvil 13, a nail 32 retained in the axial bore 27 of the anvil will be driven into a member. The nail upon being displaced out of its socket formed by the axial bore 27 will displace the balls radially as the nail is driven into position. The nailing rod is removed from the nail after it has been driven into the wood and the balls 36 will return to the position shown in FIG. 5.

It will be appreciated that various types of materials may be employed for the various components and that different types of spring members may be utilized within the contemplation of the invention.

I claim:

1. A nailing tool for supporting and driving a nail having a head thereon comprising; an elongated tubular sleeve member having one end with means for releasably retaining a nail to be driven and the opposite end having a hand grip thereon in spaced axial relation to said one end, a nail driving rod axially slidable in said elongated tubular guide sleeve member having a lower end for engaging said nail retaining means and an upper end extending beyond said hand grip on said guide sleeve member having a hand grip thereon, said nail retaining means being an anvil having an axial bore for cooperatively receiving a nail head therein, said anvil having a substantially planar driving rod impact surface on the face of the anvil opposite from said bore, and means in said axial bore for releasably engaging a nail head whereby upon axial displacement of said nail driving rod in said guide sleeve member and impact with said nail retaining means, a nail retained therein will be impacted and discharged from said retaining means after nailing.

2. A nailing tool for supporting and driving a nail having a head thereon as claimed in claim 1, said anvil having nail retaining means having a transverse bore communicating with said axial bore, said nail retaining means being positioned in said axial bore and having resilient means for urging said nail retaining means into contact with a nail in said axial bore.

3. A nailing tool for supporting and driving a nail having a head thereon as claimed in claim 1, said anvil having nail releasable retaining means including a series of radially extending bores communicating with said axial bore, a spherical ball displaceable radially in each of said radially-extending bores, each of said radially-extending bores having a ball stop means limiting ball displacement into said axial bore from each radial bore, and spring means urging each of said balls against said ball stop means to engage and retain a nail and head positioned in said axial bore until ejected by displacing the nail head against the force exerted by said spring urged balls on said nail head.

* * * * *